US010478849B2

(12) United States Patent
Yuan et al.

(10) Patent No.: US 10,478,849 B2
(45) Date of Patent: Nov. 19, 2019

(54) NOZZLE AUTO-CLEANING DEVICE AND NOZZLE AUTO-CLEANING METHOD

(71) Applicants: BOE Technology Group Co., Ltd., Beijing (CN); Hefei Xinsheng Optoelectronics Technology Co., Ltd., Hefei (CN)

(72) Inventors: Chen Yuan, Beijing (CN); Wei Zhou, Beijing (CN); Cheng Nan Hsieh, Beijing (CN); Yu Yang, Beijing (CN); Giseub Lim, Beijing (CN); Liang Yao, Beijing (CN); Hong Shao, Beijing (CN)

(73) Assignees: BOE Technology Group Co., Ltd., Beijing (CN); Hefei Xinsheng Optoelectronics Technology Co., Ltd., Hefei (CN)

( * ) Notice: Subject to any disclaimer, the term of this patent is extended or adjusted under 35 U.S.C. 154(b) by 0 days.

(21) Appl. No.: 15/574,335

(22) PCT Filed: May 5, 2017

(86) PCT No.: PCT/CN2017/083124
§ 371 (c)(1),
(2) Date: Nov. 15, 2017

(87) PCT Pub. No.: WO2017/206666
PCT Pub. Date: Dec. 7, 2017

(65) Prior Publication Data

US 2018/0229257 A1 Aug. 16, 2018

(30) Foreign Application Priority Data

Jun. 2, 2016 (CN) ..... 2016 1 0388075

(51) Int. Cl.
*B05B 15/522* (2018.01)
*B08B 9/043* (2006.01)
(Continued)

(52) U.S. Cl.
CPC ..... *B05B 15/5223* (2018.02); *B05B 15/522* (2018.02); *B08B 9/00* (2013.01);
(Continued)

(58) Field of Classification Search
CPC ..... B05B 15/522; B05B 15/5223; B08B 9/00; B08B 9/02; B08B 9/027; B08B 9/04;
(Continued)

(56) References Cited

U.S. PATENT DOCUMENTS 1,694,371 A * 12/1928 Burdick ..... B08B 9/027 15/104.03
2,812,531 A * 11/1957 Ashley ..... B08B 9/0436 134/8
(Continued)

FOREIGN PATENT DOCUMENTS

CN 203591909 U 5/2014
CN 104307672 A 1/2015
(Continued)

OTHER PUBLICATIONS

Jul. 27, 2017—International Search Report and Written Opinion Appn PCT/CN2017/083124 with Eng Tran.

*Primary Examiner* — Mark Spisich
(74) *Attorney, Agent, or Firm* — Banner & Witcoff, Ltd.

(57) ABSTRACT

A nozzle auto-cleaning device and a nozzle auto-cleaning method are disclosed. The nozzle auto-cleaning device includes a base and a cleaning piece feeding unit disposed on the base, the base has a bearing surface on which the cleaning piece feeding unit is disposed, the cleaning piece feeding unit is configured to transport a cleaning piece installed inside the nozzle auto-cleaning device along a first direction intersected with the bearing surface so that a first portion of the cleaning piece is protruded in a direction away from the bearing surface and inserted into a nozzle, and the
(Continued)

base is configured to move along at least one direction of the first direction, as well as a second direction and a third direction intersected in a plane of the bearing surface, so as to drive the first portion of the cleaning piece to move inside the nozzle.

18 Claims, 12 Drawing Sheets

(51) Int. Cl.
*B41J 2/165* (2006.01)
*B08B 9/00* (2006.01)
*B05C 5/02* (2006.01)

(52) U.S. Cl.
CPC ..... *B08B 9/043* (2013.01); *B41J 2/16517* (2013.01); *B05C 5/0254* (2013.01)

(58) Field of Classification Search
CPC .... B08B 9/043; B08B 9/0436; B41J 2/16517; B41J 2/16535; B41J 2/16538; B41J 2/16541; B41J 2/16544; B41J 2/1655; F28G 1/00; F28G 1/06; F28G 1/08; F28G 1/10; F28G 1/14; F23D 11/386; F23D 14/50; F23D 2700/024; F23D 2900/00002
USPC ..... 15/104.03, 104.05, 104.16; 239/106, 239/114, 115, 116, 123; 118/302; 347/22, 33, 34, 35; 165/95; 431/123
See application file for complete search history.

(56) References Cited

U.S. PATENT DOCUMENTS

| | | | | | |
|---|---|---|---|---|---|
| 3,354,490 | A * | 11/1967 | Masters | F28G 1/08 | 15/104.095 |
| 4,691,723 | A * | 9/1987 | Mierswa | F28G 1/163 | 118/306 |
| 5,072,788 | A * | 12/1991 | Goodwin | F28G 1/02 | 141/346 |
| 2012/0067370 | A1* | 3/2012 | Crock | B08B 9/043 | 134/6 |
| 2015/0034128 | A1* | 2/2015 | Brumfield | B08B 9/0433 | 134/22.11 |

FOREIGN PATENT DOCUMENTS

| | | | |
|---|---|---|---|
| CN | 105175770 | A | 12/2015 |
| CN | 105855133 | A | 8/2016 |
| DE | 202010012534 | U1 | 11/2010 |

* cited by examiner

NOZZLE AUTO-CLEANING DEVICE AND NOZZLE AUTO-CLEANING METHOD

The application is a U.S. National Phase Entry of International Application No. PCT/CN2017/083124 filed on May 5, 2017, designating the United States of America and claiming priority to Chinese Patent Application No. 201610388075.0, filed Jun. 2, 2016. The present application claims priority to and the benefit of the above-identified applications and the above-identified applications are incorporated by reference herein in their entirety.

Embodiments of the present disclosure relate to a nozzle auto-cleaning device and a nozzle auto-cleaning method.

BACKGROUND

In a manufacturing process of a color filter substrate (CF process) for a thin film transistor liquid crystal display (TFT-LCD) device, a coating device is disposed at a second stage of a production line and mainly used for coating a photoresist (PR) onto a substrate surface so as to form a film thereon. When switching between different PRs, or, in order to ensure a quality of the CF process, it may need to clean an inside of a nozzle of the coating device on demands or at regular intervals, so as to remove PR and/or other impurities remaining inside the nozzle. The film forming process is a foundation of the entire CF process, while a nozzle cleaning operation is the key point for ensuring a coating effect.

Existing coating devices for the CF process are all cleaned manually, for example, by an operator who holds a cleaning piece at hands and enters the inside of the coating device for nozzle cleaning. It's not only a waste of time and labor, but is also likely to cause quality issues, thereby resulting in more shut-down periods due to differences in cleaning operations which are varied depending on the operator. Moreover, the operator who enters the inside of the coating device may bring in foreign matters such as dusts and particles. In addition, dealing with PR glues or PR solutions for long time may also affect human health, more or less.

SUMMARY

At least one embodiment of the present disclosure provides a nozzle auto-cleaning device and a nozzle auto-cleaning method, which enable automatic cleaning without the need of the operator entering the device, normalize the cleaning operations, reduce the working time duration, and hence improve the cleaning efficiency and also cleaning quality.

In order to achieve the objectives above, the embodiments of the present disclosure adopt technical solutions as below.

On one aspect, the embodiments of the present disclosure provide a nozzle auto-cleaning device, including a base and a cleaning piece feeding unit disposed on the base. The base has a bearing surface on which the cleaning piece feeding unit is disposed. The cleaning piece feeding unit is configured to transport a cleaning piece installed inside the nozzle auto-cleaning device along a first direction intersected with the bearing surface so that a first portion of the cleaning piece is protruded in a direction away from the bearing surface and inserted into a nozzle. The base is configured to move along at least one direction of the first direction as well as a second direction and a third direction intersected in a plane of the bearing surface, so as to drive the first portion of the cleaning piece to move inside the nozzle.

In an example, the cleaning piece feeding unit includes at least two clamping parts which are sequentially arranged along the first direction. Each of the clamping parts is configured to be switched between a clamping state and a releasing state. The at least two clamping parts include at least one movable clamping part which is configured to be movable along the first direction so that the cleaning piece is transported in a direction away from the bearing surface.

In an example, the at least two clamping parts further include a fixed clamping part disposed farthest from the base along the first direction. The fixed clamping part is configured to be fixed in the first direction.

In an example, the cleaning piece feeding unit includes one fixed clamping part and two movable clamping parts, which are arranged sequentially along the first direction.

In an example, each of the clamping parts includes a pair of clamping elements; the clamping elements are arranged to be symmetric with respect to the first direction, and are configured to be movable towards one another to enter the clamping state or movable away from one another to enter the releasing state.

In an example, the clamping elements of the fixed clamping part constitute an insertion channel along the first direction. A size of at least a portion of the insertion channel, in a direction perpendicular to the first direction, is gradually decreased from an opening of the insertion channel towards a portion far away from the bearing surface.

In an example, the nozzle auto-cleaning device further includes a cleaning piece separator disposed along the first direction between the two movable clamping parts. The cleaning piece separator is configured to separate the first portion of the cleaning piece from the remaining portion of the cleaning piece.

In an example, the cleaning piece separator is a pair of blades; the blades are disposed in parallel to the bearing surface and are symmetric with respect to the first direction.

In an example, the nozzle auto-cleaning device further includes a cleaning piece recovery unit disposed at one side of the cleaning piece separator. The cleaning piece recovery unit is configured to receive the first portion of the cleaning piece having been separated. The cleaning piece recovery unit includes: a recovery platform disposed in parallel to the bearing surface; and a stopper disposed above the recovery platform, the stopper is configured to move towards or move away from the recovery platform in the first direction.

In an example, the movable clamping part that is disposed at one side of the cleaning piece separator far away from the bearing surface is further configured to be movable to a location above the recovery platform and is configured to be turnable.

In an example, the cleaning piece is a transparent plastic piece.

In an example, one side of the base that is facing to the bearing surface is provided with a movable holder.

In an example, the first direction is perpendicular to the bearing surface; and the second direction and the third direction are perpendicular to each other.

On another hand, the embodiments of the present disclosure further provide a nozzle auto-cleaning method by using a nozzle auto-cleaning device. The nozzle auto-cleaning device includes a base and a cleaning piece feeding unit disposed on the base; the base has a bearing surface and is configured to be movable along at least one direction of a first direction intersected with the bearing surface, as well as a second direction and a third direction intersected with each other in a plane of the bearing surface; and the cleaning piece feeding unit is disposed on the bearing surface. The auto-cleaning method includes: controlling the cleaning piece feeding unit to transport a cleaning piece installed inside the nozzle auto-cleaning device along the first direction so that a first portion of the cleaning piece is protruded in a direction away from the bearing surface and inserted into a nozzle; and controlling the base to move along at least one direction of the first direction, the second direction and the third direction so as to drive the first portion of the cleaning piece to move inside the nozzle.

In an example, the cleaning piece feeding unit in the nozzle auto-cleaning device includes at least two clamping parts which are sequentially arranged along the first direction; each of the clamping parts is configured to be switched between a clamping state and a releasing state; and the at least two clamping parts include at least one movable clamping part which is configured to be movable along the first direction so that the cleaning piece is transported in a direction away from the bearing surface. In the nozzle auto-cleaning method, controlling the cleaning piece feeding unit to transport a cleaning piece installed inside the nozzle auto-cleaning device along the first direction so that a first portion of the cleaning piece is protruded in a direction away from the bearing surface and inserted into a nozzle includes: controlling the at least one movable clamping part to move towards or move away from the bearing surface along the first direction so as to transport the first portion of the cleaning piece; the movable clamping part is in the releasing state during moving towards the bearing surface, and is in the clamping state during moving away from the bearing surface.

In an example, in the cleaning piece feeding unit of the nozzle auto-cleaning device, the at least two clamping parts further include a fixed clamping part disposed farthest from the base along the first direction; the clamping elements of the fixed clamping part are fixed in the first direction and constitute an insertion channel there-between along the first direction; an opening of the insertion channel facing the bearing surface has a size, in a direction perpendicular to the first direction, larger than a size of the remaining portion of the insertion channel, in the direction perpendicular to the first direction. In the nozzle auto-cleaning method, controlling the cleaning piece feeding unit to transport a cleaning piece installed inside the nozzle auto-cleaning device along the first direction so that a first portion of the cleaning piece is protruded in a direction away from the bearing surface and inserted into a nozzle includes: inserting the first portion of the cleaning piece into the nozzle through the insertion channel while maintaining the cleaning piece in a state of being clamped by the cleaning piece feeding unit.

In an example, the nozzle auto-cleaning device further includes a cleaning piece separator disposed along the first direction between two movable clamping parts. After controlling the base to move along at least one direction of the first direction, the second direction and the third direction so as to drive the first portion of the cleaning piece to move inside the nozzle, the nozzle auto-cleaning method further includes: controlling the cleaning piece separator to separate the first portion of the cleaning piece from the remaining portion of the cleaning piece in such a manner that the first portion of the cleaning piece is maintained in a state of being clamped by the movable clamping part disposed at one side of the cleaning piece separator far away from the bearing surface.

In an example, the nozzle auto-cleaning device further includes a cleaning piece recovery unit disposed at one side of the cleaning piece separator; the cleaning piece recovery unit includes a recovery platform disposed in parallel to the bearing surface and a stopper disposed above the recovery platform. After controlling the cleaning piece separator to separate the first portion of the cleaning piece from the remaining portion of the cleaning piece, the nozzle auto-cleaning method further includes: controlling the movable clamping part that clamps the first portion of the cleaning piece to move and turn so as to transport the first portion of the cleaning piece to a position above the recovery platform and below the stopper, at an orientation parallel to the recovery platform; and controlling the stopper to move towards the recovery platform along the first direction so as to press the first portion of the cleaning piece onto the recovery platform.

In an example, the first direction is a direction perpendicular to the bearing surface; and the second direction and the third direction are perpendicular to each other.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1:
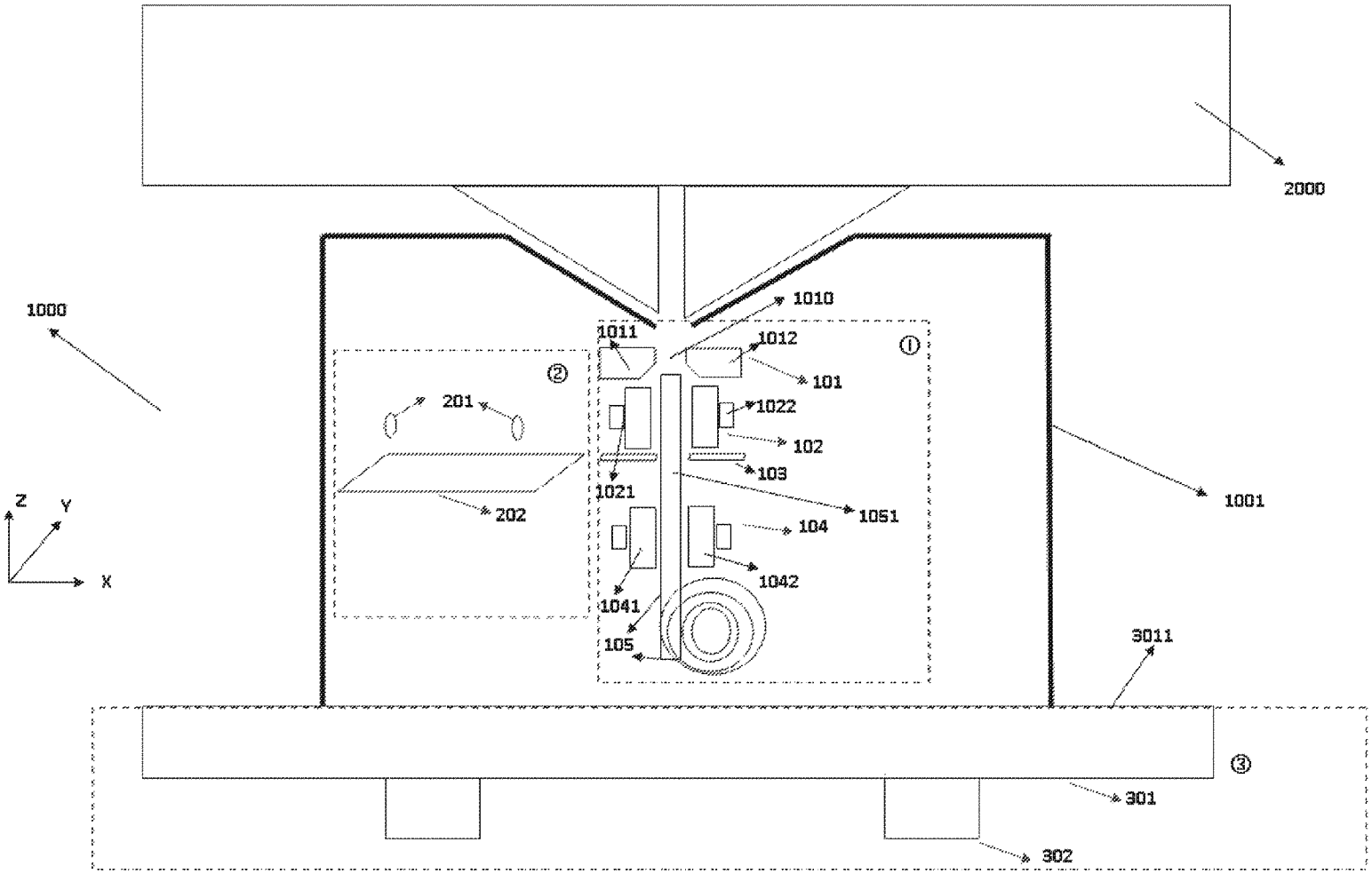
FIG. 1 is a structural schematic view of a nozzle auto-cleaning device provided by an embodiment of the present disclosure.

As illustrated in FIG. 1, the embodiments of the present disclosure provide a nozzle auto-cleaning device 1000, including a base 301 (illustrated to be within a box ③ indicated by dashed lines in FIG. 1) and a cleaning piece feeding unit (illustrated as a box ① in FIG. 1, and described in details later) disposed on the base 301. The base 301 has a bearing surface 3011 on which the cleaning piece feeding unit is disposed; the cleaning piece feeding unit is configured to transport a cleaning piece 105 installed inside the nozzle auto-cleaning device 1000 along a first direction Z intersected with the bearing surface 3011 so that a first portion 1051 of the cleaning piece 105 is protruded in a direction away from the bearing surface 3011 and inserted into a nozzle 2000. Furthermore, one side of the base 301 that is facing to the bearing surface 3011 is provided with a movable holder 302 (illustrated to be within the box ③ indicated by dashed lines in FIG. 1) so that the base 301 is movable along at least one direction of the first direction Z, as well as a second direction X and a third direction Y intersected in a plane of the bearing surface 3011, to drive the first portion 1051 of the cleaning piece 105 to move inside the nozzle 2000, thereby cleaning the inside of the nozzle 2000. Optionally, as illustrated in FIG. 1, the above-mentioned first direction Z is a direction perpendicular to the bearing surface 3011; and the above-mentioned second direction X and third direction Y are perpendicular to each other in the plane of the bearing surface 3011. However, the embodiments of the present disclosure are not limited thereto.

According to the embodiment of the present disclosure, as illustrated in FIG. 1, the cleaning piece feeding unit includes at least two clamping parts which are sequentially arranged along the first direction Z. Each of the clamping parts is configured to be switched between a clamping state and a releasing state. In the clamping state, the cleaning piece is clamped, while in the releasing state, the cleaning piece is released. For example, each of the clamping parts includes a pair of clamping elements; the two clamping elements are arranged to be symmetric with respect to the first direction, and are configured to be movable in a direction perpendicular to the first direction Z, so as to be closer to each other to enter the clamping state or to be far away from each other to enter the releasing state. Furthermore, the clamping parts of the cleaning piece feeding unit include at least one movable clamping part which is movable along the first direction Z; for example, when the movable clamping part is consisted by the above-mentioned one pair of clamping elements, the two clamping elements can not only move with respect to each other in a direction perpendicular to the direction Z, but can also move along the first direction Z, so as to transport the cleaning piece 105 along a direction away from the bearing surface. Optionally, in some embodiments of the present disclosure, when the clamping part enters the clamping state, a spacing d between the clamping elements thereof is adapted to a width w1 of a channel 2001 of the nozzle 2000, while the width w1 of the channel 2001 is adapted to a width w2 of the cleaning piece 105 to be clamped.

According to the embodiment of the present disclosure, as illustrated in FIG. 1, the at least two clamping parts of the cleaning piece feeding unit may further include a fixed clamping part. The fixed clamping part is usually disposed at a location farthest from the base 301 along the first direction Z; and the two clamping elements that constitute the fixed clamping part are configured to be switched between the aforementioned clamping state and the aforementioned releasing state only, but cannot be moved (i.e., fixed) in the first direction Z. Furthermore, according to the embodiment of the present disclosure, an insertion channel extending along the first direction Z may be formed between the two clamping elements which constitute the fixed clamping part, so as to facilitate a smooth insertion of the first portion 1051 of the cleaning piece 105.

For example, in an embodiment, as illustrated in FIG. 1, the cleaning piece feeding unit may include one fixed clamping part 101 and two movable clamping parts 102, 104, which are arranged sequentially along the first direction Z towards the base 301. The fixed clamping part 101 includes two clamping elements 1011, 1012 (i.e., a pair of clamping elements) which are symmetric with respect to the first direction Z; the clamping elements 1011, 1012 are movable with respect to each other in a direction perpendicular to the first direction Z, so as to be closer to each other to enter the clamping state or to be far away from each other to enter the releasing state; however, the clamping elements 1011, 1012 are fixed and not movable along the first direction Z. An insertion channel 1010 is defined between the clamping elements 1011, 1012; and in an example, a size of at least a portion of the insertion channel 1010, in a direction perpendicular to the first direction, is gradually decreased from an opening of the insertion channel 1010 towards a portion far away from the bearing surface 3011, that is, the insertion channel is formed to have an inversed-V shape to facilitate the insertion of the cleaning piece. Similarly, the movable clamping part 102, 104 are respectively formed by a pair of clamping elements 1021, 1022, and a pair of clamping elements 1041, 1042. The clamping elements 1021, 1022 or the clamping elements 1041, 1042 may be movable to be closer to each other or movable to be far away from each other, and also are movable towards the bearing surface or movable away from the bearing surface in the first direction Z, so as to enable transporting the cleaning piece 105 along a direction away from the bearing surface 3011, segment by segment, in a manner of relay transmission. Hereinafter the transport process will be described in details with reference to FIGS. 4A-4D.

Herein, it should be explained that, although an embodiment of the cleaning piece feeding unit including two movable clamping parts and one fixed clamping part is described in conjunction with FIG. 1, the present disclosure is not limited thereto. For example, in some embodiments, the cleaning piece feeding unit may only include two movable clamping parts, so as to directly transport the cleaning piece 105, segment by segment, in a manner of relay transmission, to a position right below the nozzle 2000 and then insert the same into the nozzle 2000, without the need of inserting the cleaning piece 105 through the insertion channel defined by a fixed clamping part (which is not arranged). For another example, in some other embodiments, the cleaning piece feeding unit may include one fixed clamping part and more than two movable clamping parts; or include more than two movable clamping parts and no fixed clamping part. In some other embodiments, the cleaning piece feeding unit may only include one movable clamping part and one fixed clamping part. The number of the movable clamping part and the number of the fixed clamping part in the cleaning piece feeding unit may be flexibly arranged by those skilled in the art according to a transport speed as required and a length of the cleaning piece, as long as it ensures that the cleaning piece feeding unit includes at least two clamping parts and one of which is a movable clamping part.

Optionally, in some embodiments of the present disclosure, the nozzle auto-cleaning device 1000 may further include a cleaning piece separator (illustrated to be within a box ② indicated by dashed lines in FIG. 1) disposed between the two movable clamping parts of the cleaning piece feeding unit. The cleaning piece separator is configured to separate the first portion 1051 of the cleaning piece 105 having been inserted into the nozzle 2000 from the remaining portion of the cleaning piece 105. Still referring to FIG. 1, the cleaning piece separator may be a pair of blades 103 which is disposed between the movable clamping parts 102,104, and is parallel to the bearing surface 3011; in such case, by moving the blades 103 to be closer to each other, the cleaning piece 105 may be cut off.

Optionally, in some embodiments of the present disclosure, the nozzle auto-cleaning device 1000 may further include a cleaning piece recovery unit (illustrated to be within the box ② indicated by dashed lines in FIG. 1) disposed on the base 301. The cleaning piece recovery unit is configured to receive the first portion 1051 of the cleaning piece 105 having been separated. Still referring to FIG. 1, the cleaning piece recovery unit may include: a recovery platform 202 which is disposed at one side of the blades 103 on the base 301, and is parallel to the bearing surface 3011; and a pair of stoppers 201 (see FIGS. 4A-4D) which is disposed above the recovery platform 202 and is movable along the first direction Z.

In such case, optionally, the at least one movable clamping part of the cleaning piece feeding unit may be configured to transport the first portion 1051 having been separated from the cleaning piece 105 to the recovery platform 202. For example, as illustrated in FIG. 1, the movable clamping part 102 located above the blades 103 may be turned anticlockwise by 90 degrees and meanwhile moving along a direction parallel to the bearing surface 3011 until arriving at a position immediately above the recovery platform 202; at this moment, it only requires to control the stoppers 201 to move downwards to press against the separated first portion 1051 and move the first portion 1051 towards the recovery platform 202; afterwards, it only requires to control the clamping elements of the movable clamping part 102 to move away from each other so as to release the first portion 1051, and place the first portion 1051 onto the recovery platform 202 (described in details later).

Figure 2:
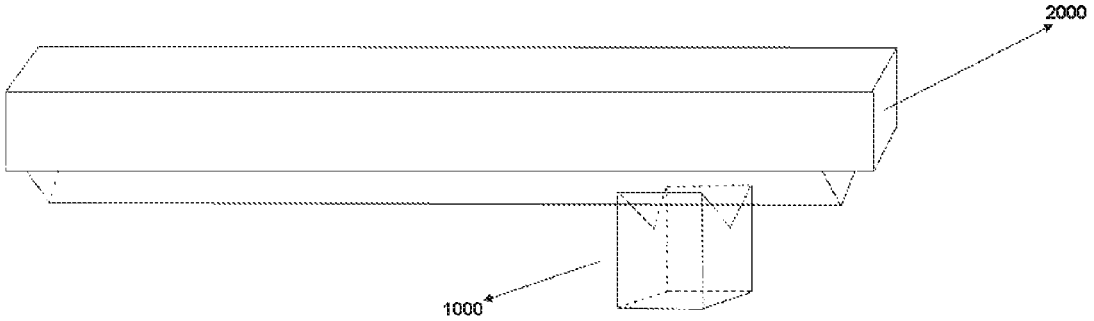
FIG. 2 is a schematic view illustrating a configuration of the nozzle auto-cleaning device provided by an embodiment of the present disclosure when used.

According to the embodiment of the present disclosure, as illustrated in FIG. 1 and FIG. 2, the aforementioned cleaning piece feeding unit, and optionally the aforementioned cleaning piece separator and cleaning piece recovery unit, may be disposed within a housing 1001 having an opening 1001' at a top end thereof. A size of the opening 1001' is matched with the width w1 of the channel 2001 of the nozzle 2000 and is adapted to allow the cleaning piece 105 to be protruded there-through; the aforementioned base 301 is disposed at a bottom of the housing 1001. Optionally, still referring to FIG. 1 and FIG. 2, the top end of the housing 1001 may be formed into a shape matched with the taper-shaped nozzle 2000. Before cleaning the nozzle by using the nozzle auto-cleaning device 1000, it's possible to move the base 301 to bring the above-mentioned tapper-shaped top end of the housing 1001 into attaching with an edge of the nozzle 2000; then the nozzle auto-cleaning device 1000 may be controlled to transport the cleaning piece and clean the nozzle.

Figure 3:
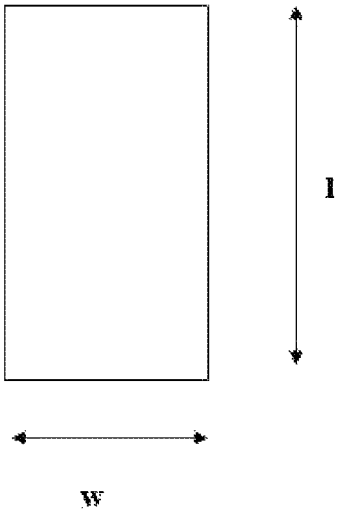
FIG. 3 is a structural schematic view of a cleaning piece disposed in the nozzle auto-cleaning device provided by an embodiment of the present disclosure.

According to the embodiment of the present disclosure, as illustrated in FIG. 3, the cleaning piece 105 may be a transparent plastic piece having a width of about 20 mm-40 mm, for example, a length determined by random tailoring, and a thickness of about 0.1 mm-0.3 mm. However, the embodiments of the present disclosure are not limited thereto, but may be flexibly arranged according to actual application object and operation requirements.

Hereinafter the working principles of the cleaning piece feeding unit including two movable clamping parts 102, 104 and one fixed clamping part 101 in the nozzle auto-cleaning device provided by the embodiment of the present disclosure will be described in more details with reference to FIGS. 4A-4D. Those skilled in the art should be appreciated that, other cleaning piece feeding units with different structures may also be operated based on similar principles.

Figure 4A:
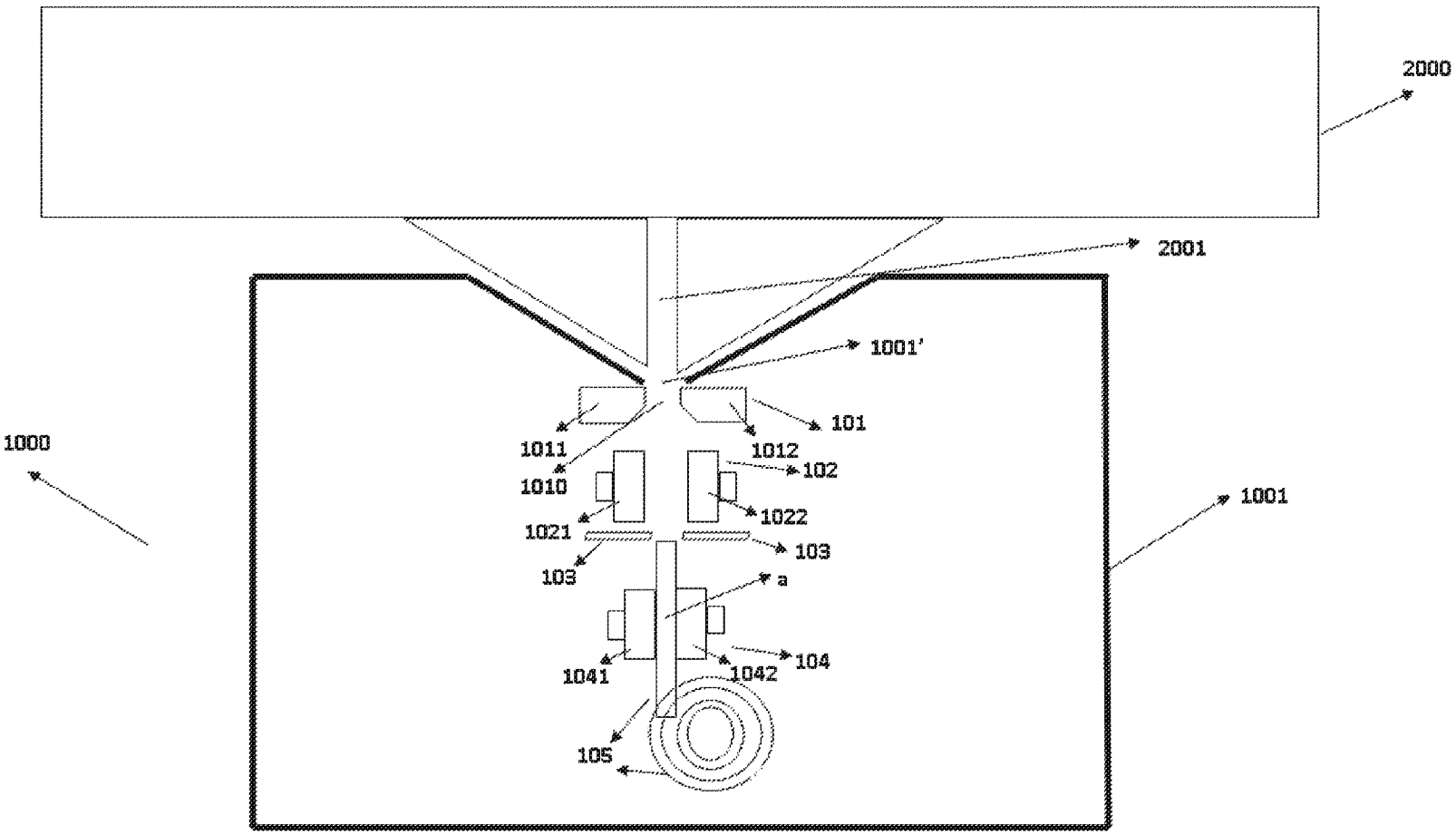
FIG. 4A-4D are schematic views illustrating working principles of a cleaning piece feeding unit of the nozzle auto-cleaning device provided by an embodiment of the present disclosure.

As illustrated in FIG. 4A, a cleaning piece to be used, for example, a plastic film 105 is disposed on the base 301 in a form of scroll. Before activating the nozzle auto-cleaning device, placing a starting segment (indicated by "a" in the figure) of a portion of the cleaning piece 105, that is to be transported, into a space between the clamping elements 1041, 1042 of a first movable clamping part 104 disposed closest to the base 301, and controlling the clamping elements 1041, 1042 to move towards one another to tightly clamp at least part of the segment "a", and then controlling the first movable clamping part 104 to move, and hence drive the segment "a" to move, towards a second movable clamping part 102 along the first direction Z in such a manner that the first movable clamping part 104 maintains the clamping state while both of the second movable clamping part 104 and the fixed movable clamping part 101 being in the releasing state.

Figure 4B:
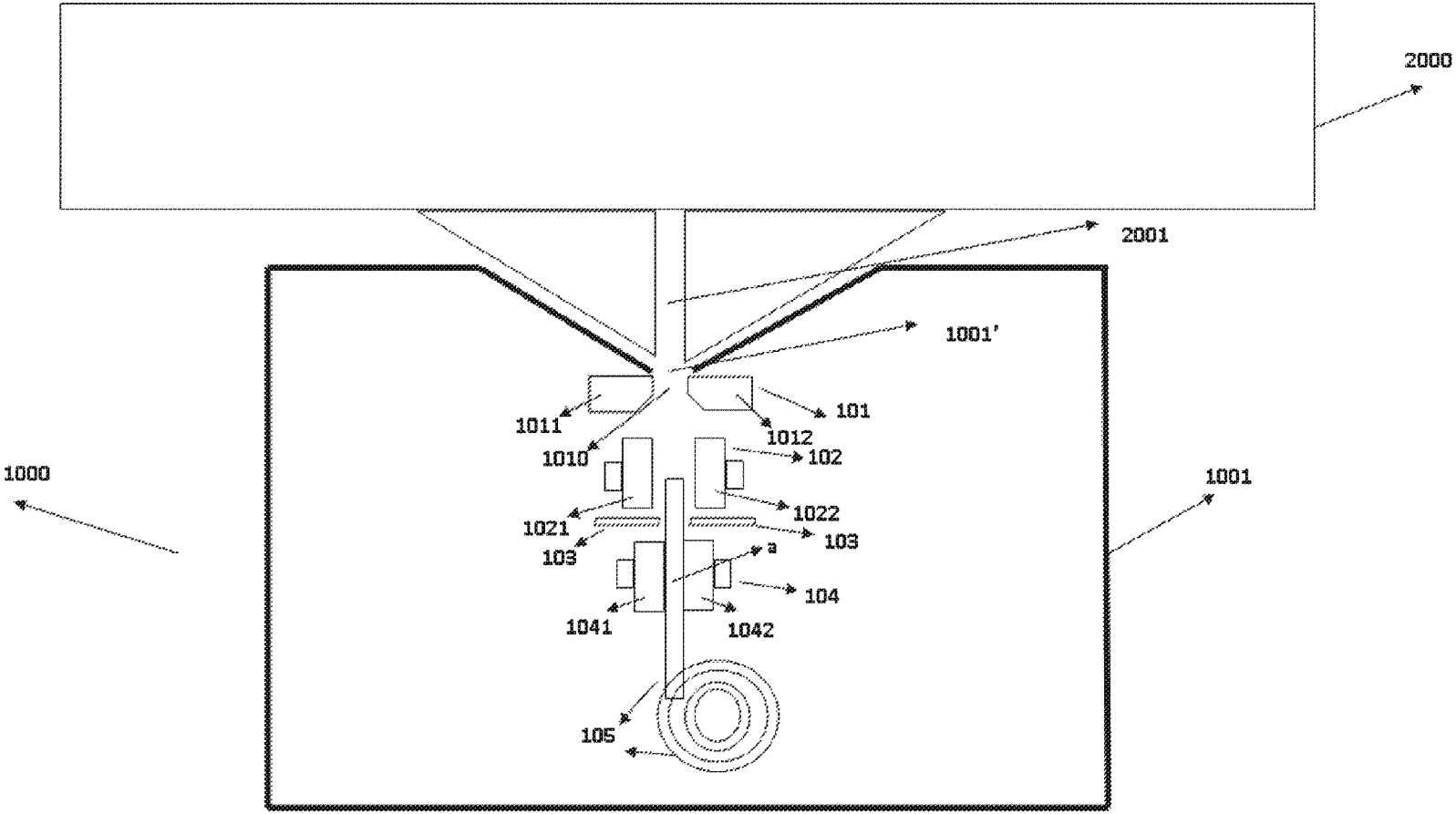

Subsequently, as illustrated in FIG. 4B, during the first movable clamping part 104 moving to a position immediately below the second movable clamping part 102, controlling the second movable clamping part 102 to move towards the first movable clamping part 104 along the first direction Z in such a manner that the second movable clamping part 102 maintains the releasing state, until at least part of the segment "a" of the cleaning piece 105 is protruded into a space between the clamping elements 1021, 1022 of the second movable clamping part 102.

Figure 4C:
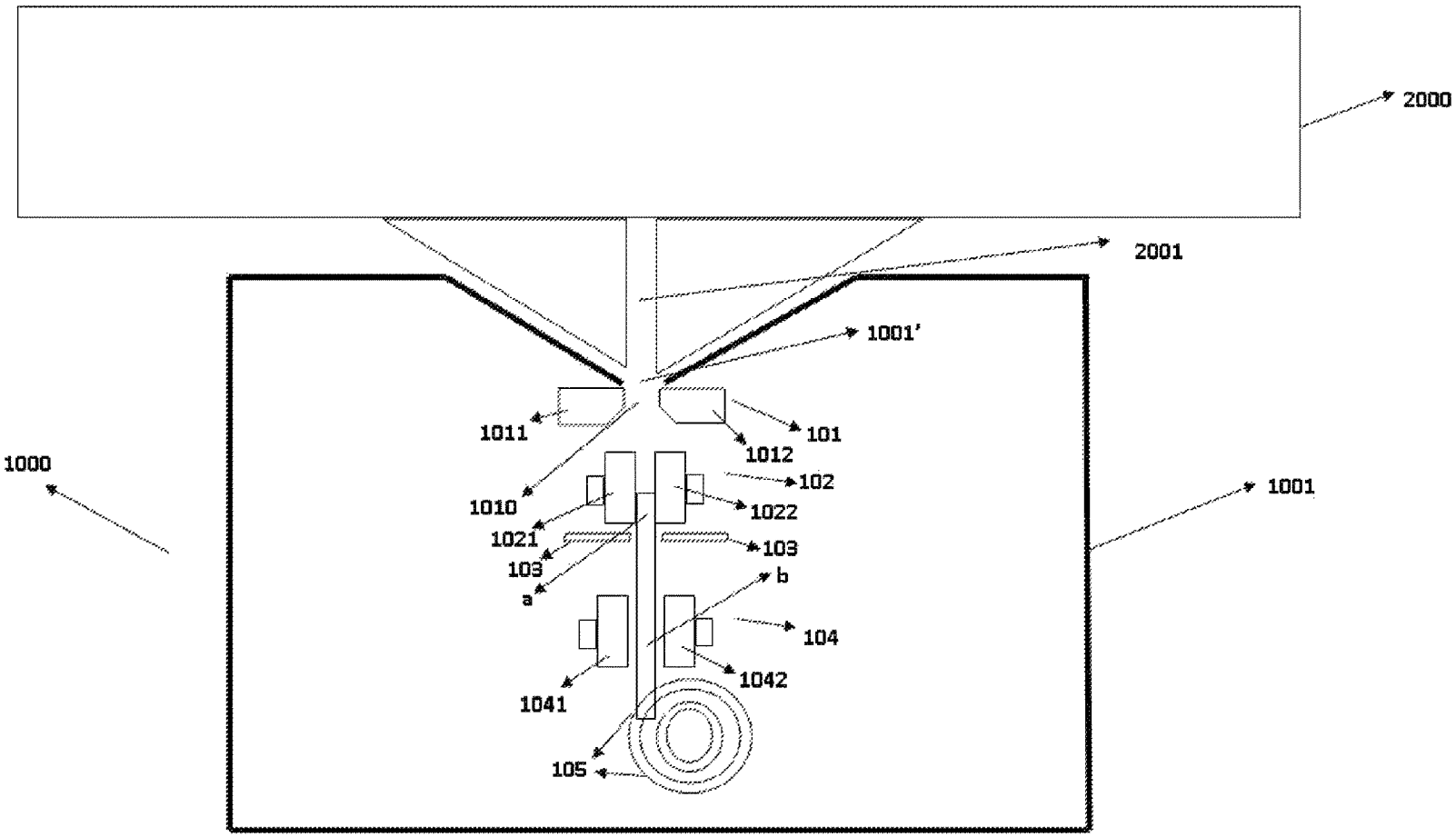

Subsequently, as illustrated in FIG. 4C, controlling the clamping elements 1021, 1022 of the second movable clamping part 102 to move towards one another to clamp at least part of the segment "a" of the cleaning piece 105. Then, controlling the second movable clamping part 102 to move towards the fixed clamping part 101 in such a manner that the second movable clamping part 102 maintains the clamping state; at the same time, controlling the clamping elements 1041, 1042 of the first movable clamping part 104 to move away from each other to release the starting segment. Then, controlling the first movable clamping part 104 to move towards the base 301 along the first direction Z in such a manner that the first movable clamping part 104 maintains the releasing state, until approaching to a next segment (indicated by "b" in the figure) of the cleaning piece 105 to be transported.

Figure 4D:
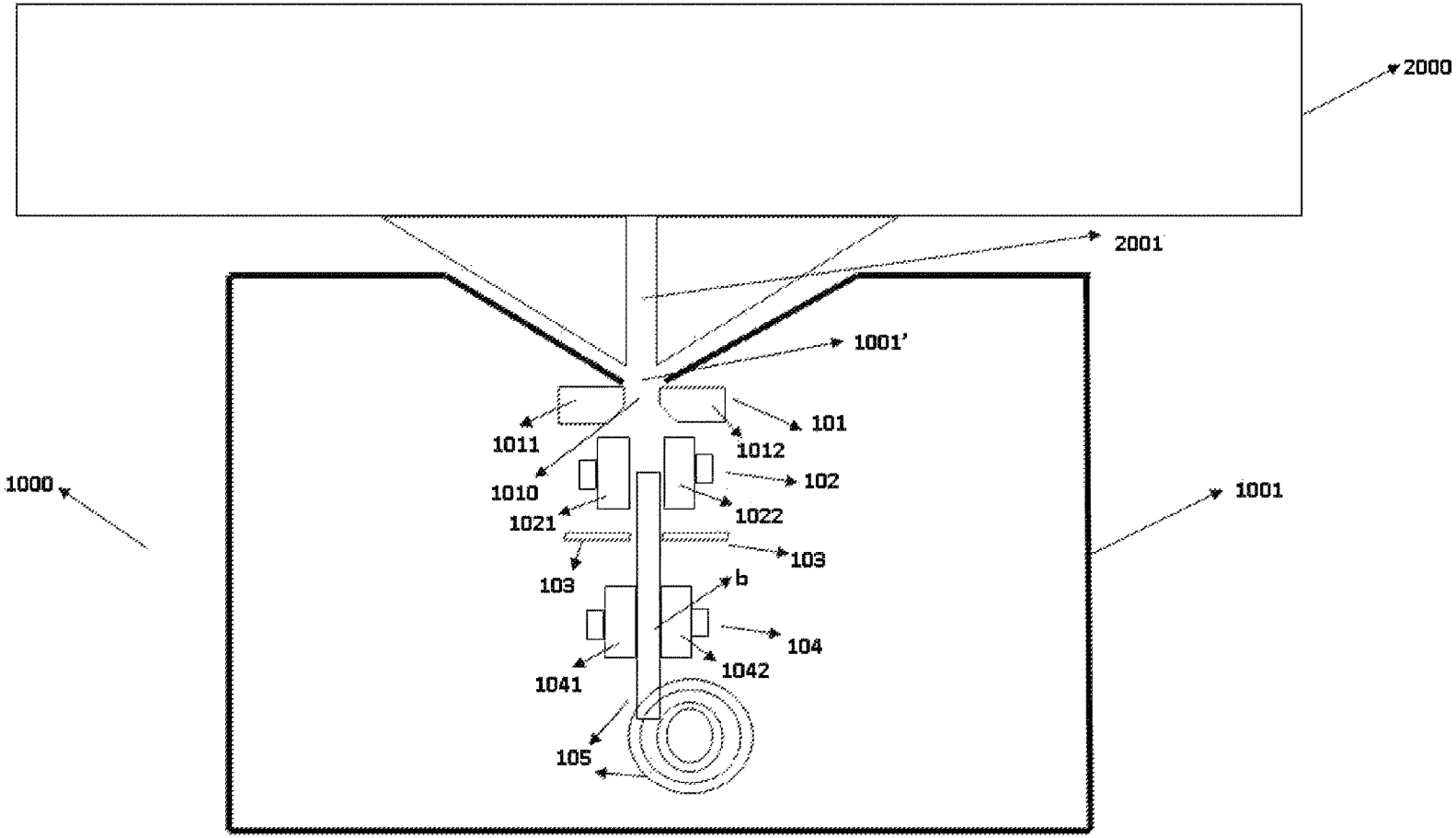

Subsequently, as illustrated in FIG. 4D, controlling the clamping elements 1041, 1042 of the first movable clamping part 104 to move towards one another to clamp the segment "b" of the cleaning piece 105; then controlling the clamping elements 1021, 1022 of the second movable clamping part 102 to move away from one another to release the segment "a" of the cleaning piece 105; then controlling the first movable clamping part 104 to move towards the second movable clamping part 102 along the first direction Z in such a manner that the first movable clamping part 104 maintains the clamping state, until at least part (illustrated as 1051 in the figure) of the segment "b" of the cleaning piece 105 enters a space between the clamping elements 1021, 1022 of the second movable clamping part 102.

Hereafter, controlling the first movable clamping part 104 and the second movable clamping part 102 to repeat the above operations, until a portion having a predetermined length (e.g., a length adapted to a depth of the nozzle to be cleaned; in the present embodiment, the portion having such length is referred to as a first portion 1051) of the cleaning piece 105 is completely inserted inside the nozzle 2000 through the insertion channel 1010 defined by the fixed clamping part 101. In an example, a length of the portion of the cleaning piece 105 inserted into the nozzle may be ranged from 20 mm to 50 mm.

Herein, it should be explained that, in case the cleaning piece feeding unit includes more than two movable clamping parts, then the movable clamping parts may be cooperated with each other in a manner similar with the aforementioned process to move towards or move away from the bearing surface along the first direction Z, in a manner of maintaining the releasing state during moving towards the bearing surface while maintaining the clamping state during moving away from the bearing surface, thereby transporting the cleaning piece 105 segment by segment, in a manner of relay transmission.

According to the embodiment of the present disclosure, after completion of the transport operation, it may be possible to control at least one clamping part to enter the clamping state of clamping at least part of the cleaning piece 105 which is outside the nozzle, and then drive at least part of the cleaning piece 105 to move inside the nozzle 2000 for cleaning by moving the base 301 to move in at least one direction of the first direction Z, the second direction X and the third direction X.

Optionally, in some embodiments of the present disclosure, after completion of the cleaning operation, it may be possible to separate and recovery the portion 1051 of the cleaning piece 105 having been used once, by using the cleaning piece separator and the cleaning piece recovery unit, in such a manner that the cleaning piece feeding unit maintains a state of clamping the cleaning piece 105.

Hereinafter the working principles of the cleaning piece separator and the cleaning piece recovery unit in the nozzle auto-cleaning device 1000 provided by the embodiment of the present disclosure will be described in more details with reference to FIGS. 5A-5E. Herein, the case where the cleaning piece separator includes two blades 103 (i.e., a pair of blades) disposed symmetrically with respect to the first direction Z and the cleaning piece recovery unit is disposed at one side of the cleaning piece separator is described in details, by way of example. From this, those skilled in the art may conceive of the working principles of cleaning piece separators and cleaning piece recovery units having other different structures, without repeating herein.

Figure 5A:
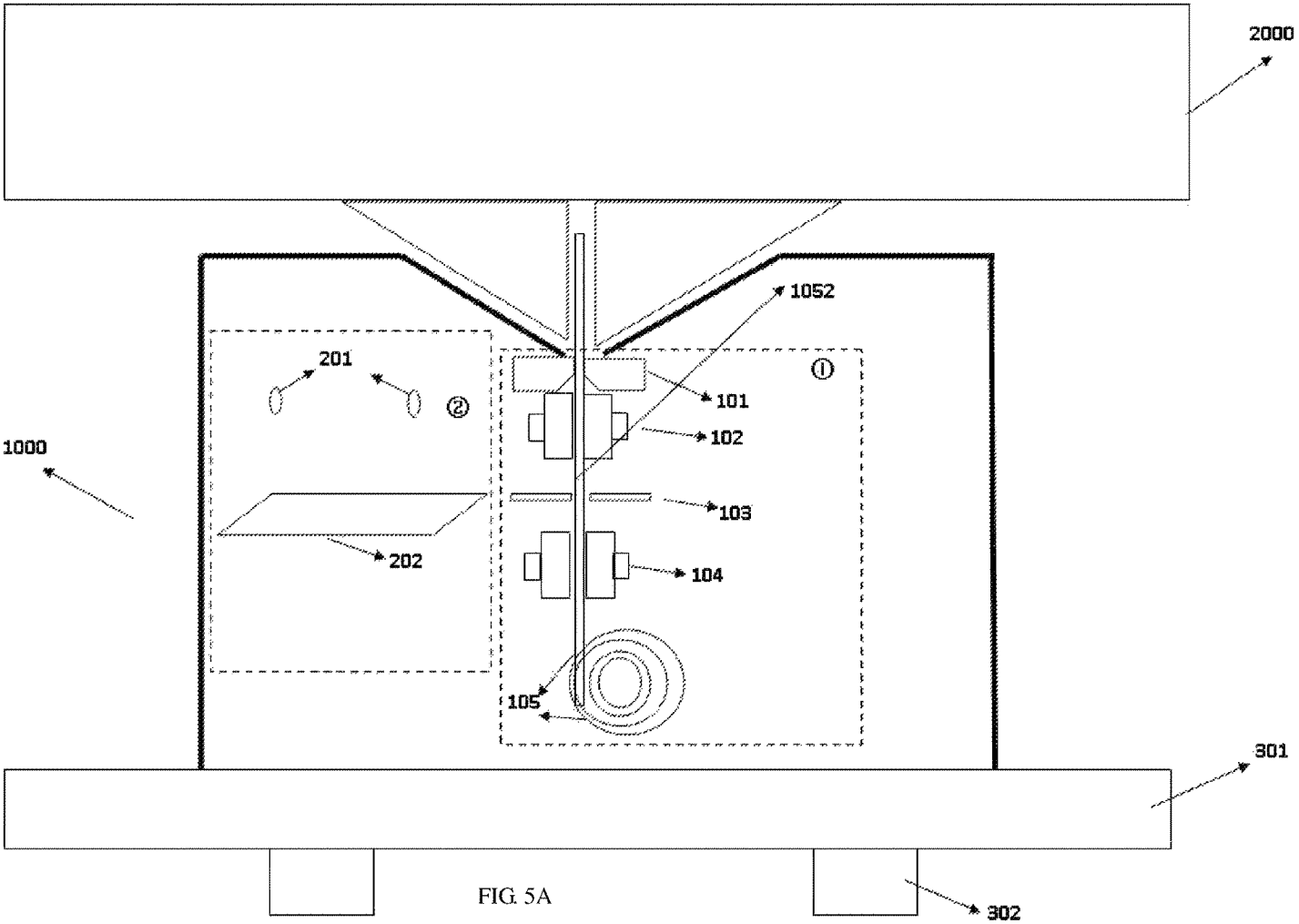
FIG. 5A-5E are schematic views illustrating working principles of a cleaning piece separator and a cleaning piece recovery unit of the nozzle auto-cleaning device provided by an embodiment of the present disclosure.

As illustrated in FIG. 5A, after completion of the cleaning operation, the first portion 1051 of the cleaning piece 105 maintains the state of being inserted in the nozzle 2000, while the fixed clamping part 101 and the movable clamping parts 102, 104 maintain the state of clamping the cleaning piece 105. Of course, in other embodiments, it's also possible that only the movable clamping parts 102, 104 maintain the state of clamping the cleaning piece, or only the fixed clamping part 101 and one movable clamping part 102 or 104 maintain the state of clamping the cleaning piece.

Figure 5B:
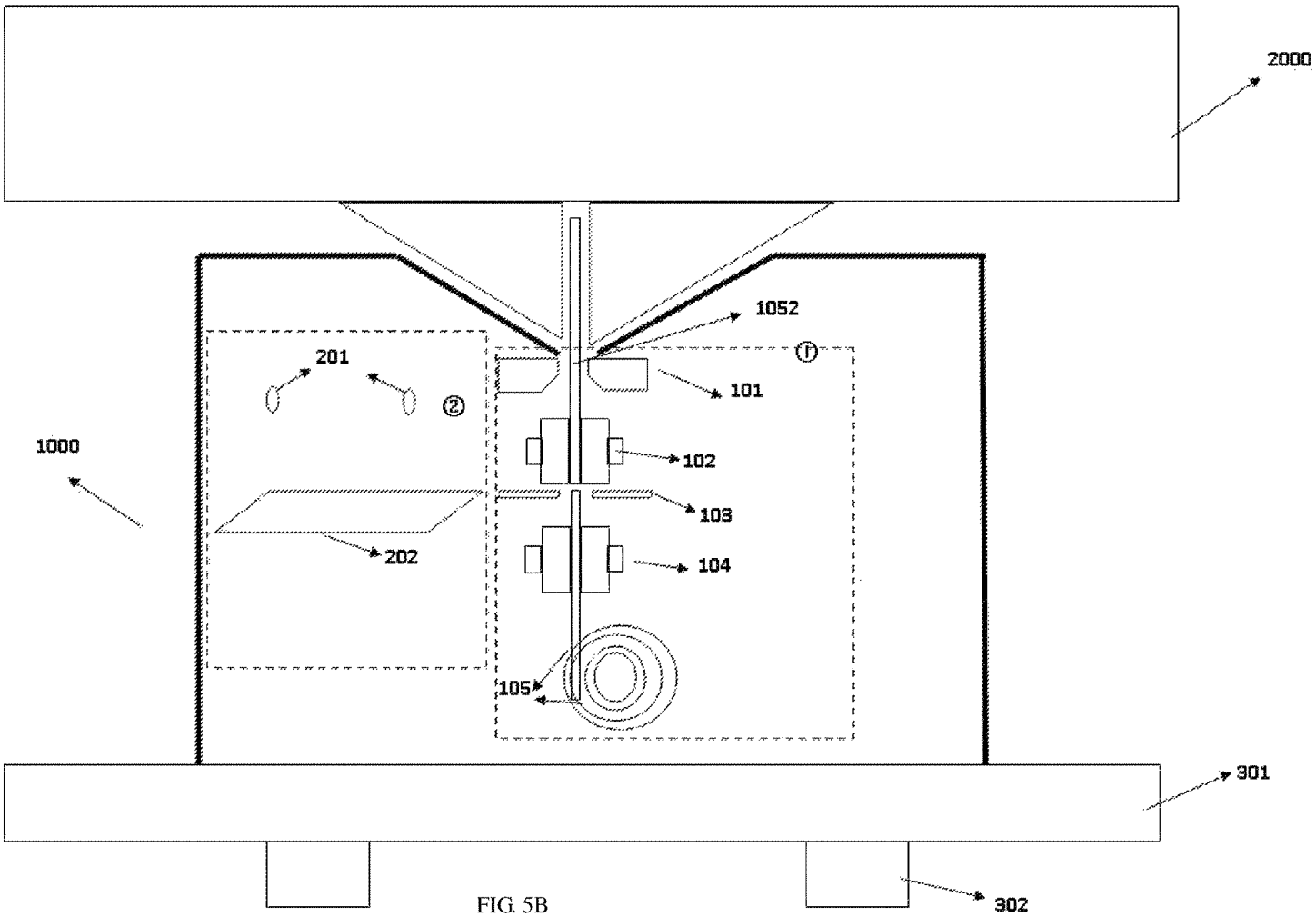

Subsequently, as illustrated in FIG. 5B, controlling the fixed clamping part 101 to release the cleaning piece, and meanwhile controlling the second movable clamping part 102 to move towards the blades 103 along the first direction Z, until reaching a position immediately above the blades 103 where the corresponding portion of the cleaning piece 105 will be clamped by the second movable clamping part 102; then controlling the two blades 103 to move towards one another to cut off the cleaning piece 105 so that the first movable clamping part 104 and the second movable clamping part 102 respectively clamp a separated portion 1052 (obviously including the aforementioned first portion 1051 which is inserted into the nozzle) of the cleaning piece 105 and the remaining portion of the cleaning piece 105. Herein, it should be explained that, when it needs to clean the nozzle for a second time, the first movable clamping part 104 that clamps the above-mentioned remaining portion of the cleaning piece 105 may start to perform a new transportation from the above-mentioned step described with reference to FIG. 4A, without repeating herein.

Figure 5C:
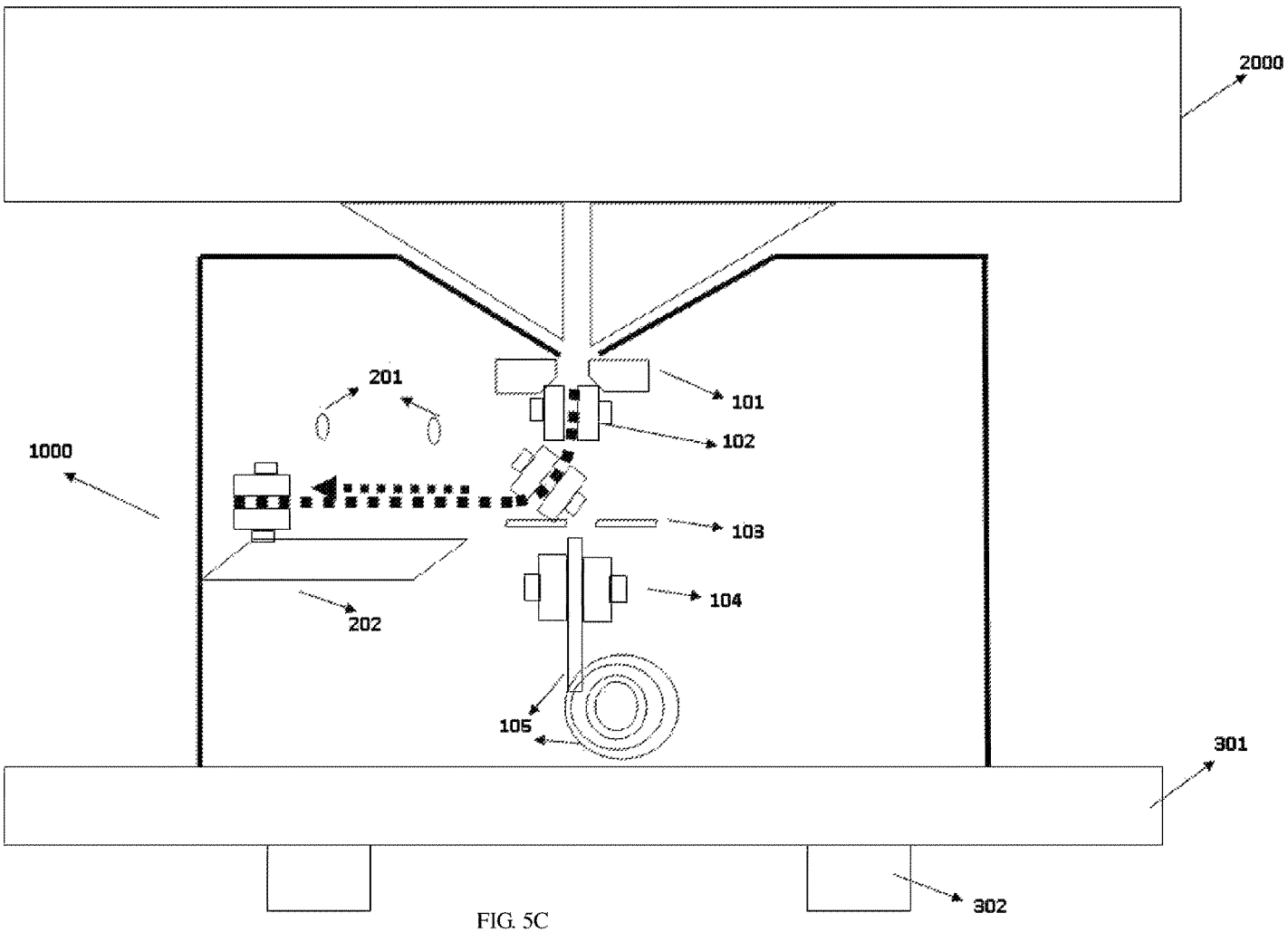

Subsequently, as illustrated in FIG. 5C, controlling the second movable clamping part 102 to move along a path indicated by the dash lines, in a state of clamping the separated portion 1052 of the cleaning piece 105, until transporting the separated portion 1052 to a position above the recovery platform 202. For example, the second movable clamping part 102 that clamps the separated portion 1052 may, first of all, move downwards along a vertical direction, until the separated portion 1052 totally leaves the nozzle 2000, so as to prevent the portion 1052 from broken; then the second movable clamping part 102 may be controlled to make translation movement to the left side and meanwhile turning anticlockwise by 90 degrees, until the separated portion 1052 reaches a position above the recovery platform 202 and below the stoppers 201, at a substantially horizontal orientation.

Figure 5D:
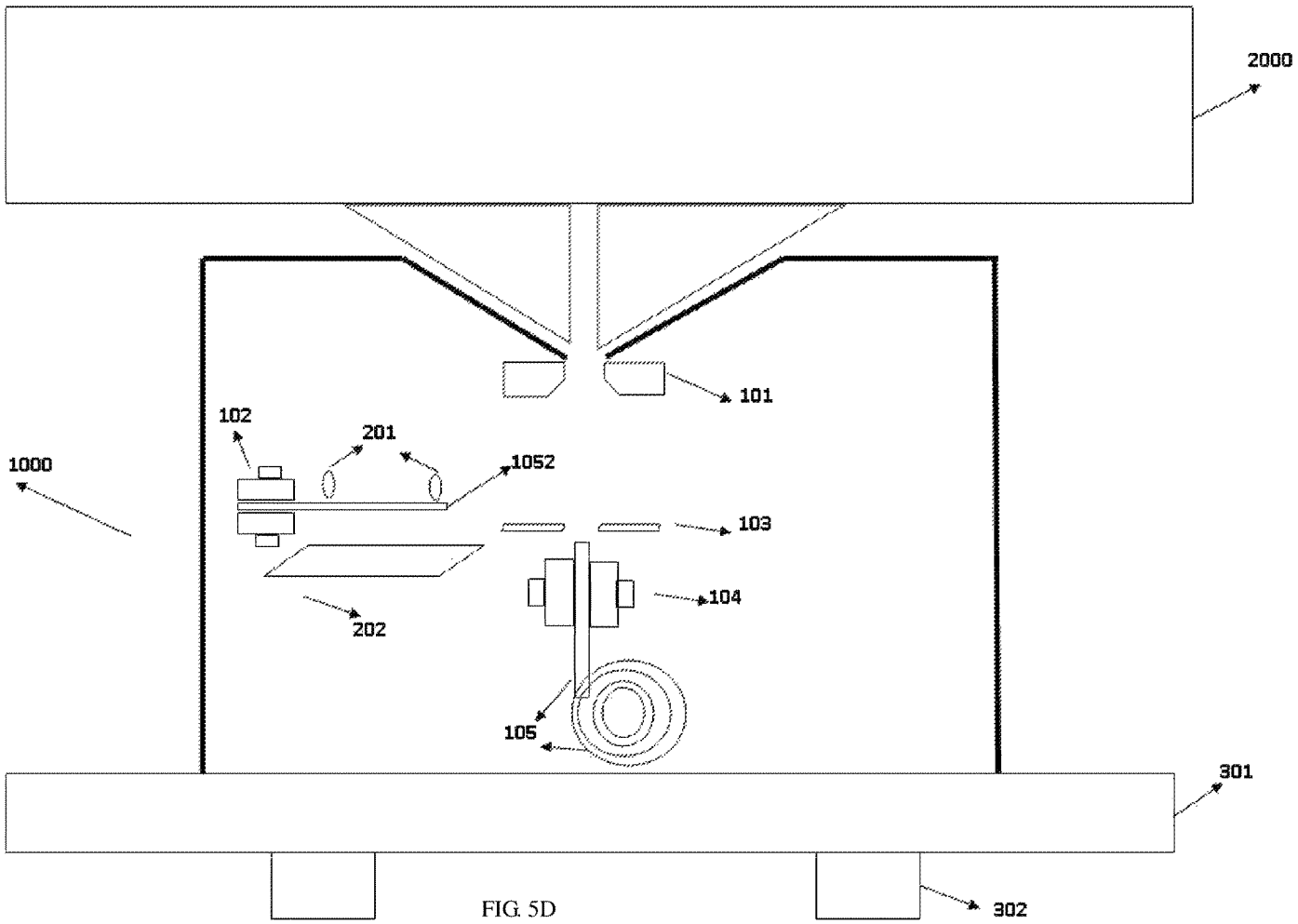

Subsequently, as illustrated in FIG. 5D, controlling the stoppers 201 to move downwards so as to contact and press against the separated portion 1052 clamped by the second movable clamping part 102 so that the separated portion 1052 moves towards the recovery platform 202 (during this process, the second movable clamping part 102 also moves towards the recovery unit) until the separated portion 1052 comes into contact with the surface of the recovery platform 202; at this moment, controlling the clamping elements 1021, 1022 of the second clamping part 102 to move away from one another to slowly release the separated portion 1052 until the separated portion 1052 completely falls onto the recovery platform 202.

Figure 5E:
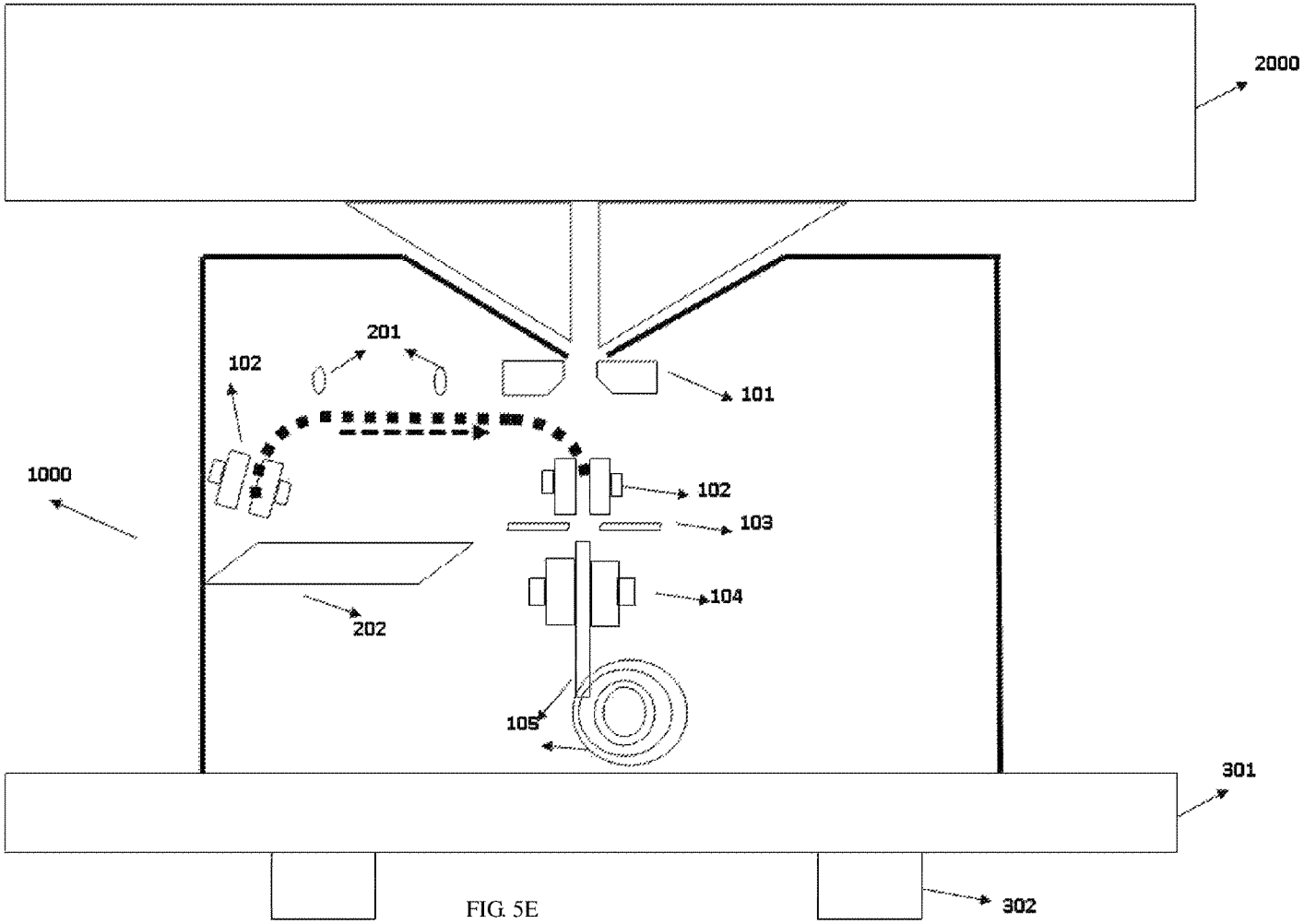

Subsequently, as illustrated in FIG. 5E, controlling the second movable clamping part 102 to move along the path indicated by the dash lines until returning to a starting position. For example, controlling the second movable clamping part 102 to make translation movement to the right side and turns clockwise by 90 degrees, until returning to the starting position.

Herein, it should be explained that, in the embodiment of the nozzle auto-cleaning device 1000 provided with the aforementioned cleaning piece separator and the aforementioned cleaning piece recovery unit, at least one movable clamping part may be further configured to perform the aforementioned actions of the second movable clamping part such as the translation movement, the downward movement, the clockwise turning movement and the anticlockwise turning movement, after completing the cleaning operation. Moreover, the movable clamping part may also be switched between the releasing state and the clamping state upon completing the turning movement. For example, when the clamping elements of the movable clamping part turn to be perpendicular to the first direction Z, they may further move away from one another or move towards one another in the first direction Z so as to enter the releasing state or the clamping state.

Correspondingly, in the above embodiment, the inside of the housing 1001 of the nozzle auto-cleaning device 1000 may be further provided with a mechanism which allows the movable clamping part to act along the path indicated by dash lines in FIGS. 5A-5E. For example, the mechanism may be a sliding track including a vertical portion, a horizontal portion and an arc-shaped turning portion. The movable clamping part may be slidable along the sliding track so as to achieve upward and downward movement by sliding on the vertical portion, achieve the leftward and rightward movement by sliding on the horizontal portion, and achieve clockwise and anticlockwise turning movement by sliding on the arc-shaped turning portion. Of course, the mechanism may also be implemented by other mechanical, pneumatic, hydraulic, electrical or electromagnetic structures, without going into details herein.

It should be explained that, in other embodiments, the recovery platform 202 and the stoppers 201 may also be disposed at the right side of the blades 103 and operated similarly to that described above, without going into details herein.

Figure 6:
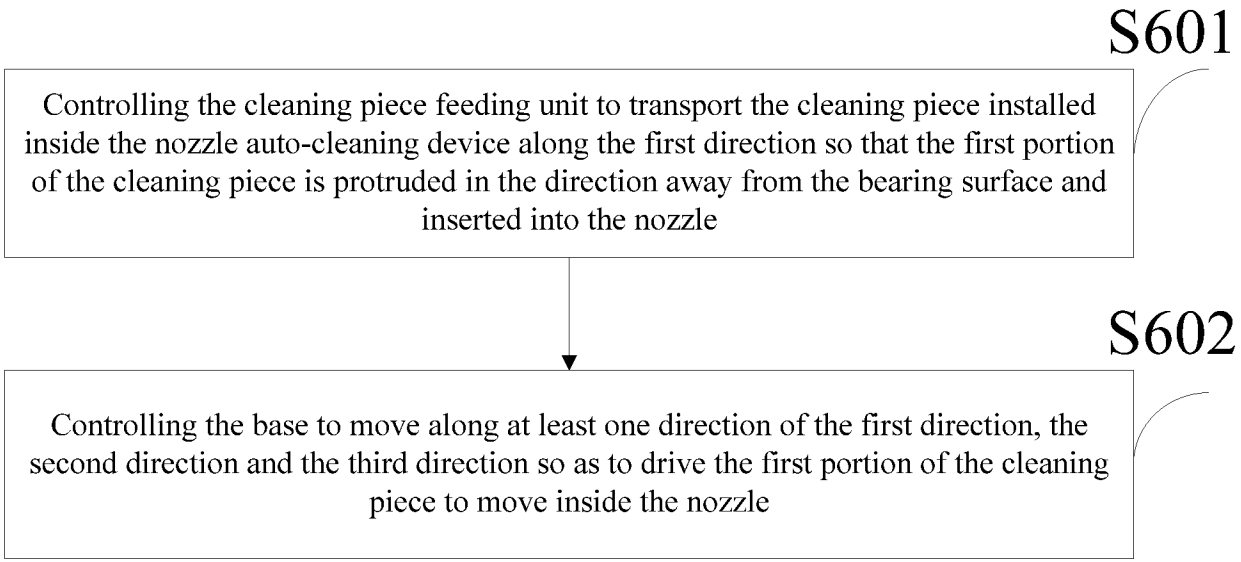
FIG. 6 is a flow chart illustrating a nozzle auto-cleaning method provided by an embodiment of the present disclosure.

On the basis of identical inventive concepts, embodiments of the present disclosure further provide a nozzle auto-cleaning method using the foregoing nozzle auto-cleaning device. As illustrated in FIG. 6, the nozzle auto-cleaning method includes steps as below.

Step S601, controlling the cleaning piece feeding unit to transport the cleaning piece 105 installed inside the nozzle auto-cleaning device 1000 along the first direction Z so that the first portion 1051 of the cleaning piece 105 is protruded in the direction away from the bearing surface 3011 and inserted into the nozzle 2000.

Step S602, controlling the base 301 to move along at least one direction of the first direction Z, the second direction X and the third direction Y so as to drive the first portion 1051 of the cleaning piece 105 to move inside the nozzle 2000.

In some embodiments, the step S601 may further include steps as below.

Step S6011, controlling at least one movable clamping part to move towards or move away from the bearing surface 3011 along the first direction Z so as to transport the first portion 1051 of the cleaning piece 105; and the movable clamping part is in the releasing state during moving towards the bearing surface 3011, and is in the clamping state during moving away from the bearing surface 3011.

For example, during the movable clamping part moving away from the bearing surface, other clamping parts may be in the releasing state; during the movable clamping part moving towards the bearing surface, other clamping parts may be in the clamping state.

In some embodiments, the step S601 may further include steps as below.

Step S6012, inserting the first portion 1051 of the cleaning piece into the nozzle 2000 through the insertion channel 1010 defined by the fixed clamping part.

In some embodiments, after the step S602, the nozzle auto-cleaning method may further include the steps as below.

S6031, controlling at least one movable clamping part to maintain in a state of clamping the cleaning piece 105;

S6032, controlling the cleaning piece separator to separate the first portion 1051 of the cleaning piece from the remaining portion of the cleaning piece.

In some embodiments, after the step S602, the nozzle auto-cleaning method may further include the steps as below.

S6033, controlling the at least one movable clamping part to transport the first portion 1051 of the cleaning piece having been separated to the cleaning piece recovery unit.

Herein, it should be explained that, specific implementations of the nozzle auto-cleaning method provided by the embodiments of the present disclosure may refer to the foregoing descriptions of the nozzle auto-cleaning device and working principles thereof in conjunction with FIGS. 1-5E, without going into details herein.

What are described above is the embodiments of the present disclosure only and not limitative to the scope of the present disclosure; any of those skilled in related arts can easily conceive variations and substitutions in the technical scopes disclosed by the present disclosure, which are encompassed in protection scopes of the present disclosure. Therefore, the scopes of the present disclosure should be defined in the appended claims.

The application claims priority to the Chinese patent application No. 201610388075.0 titled "NOZZLE AUTO-CLEANING DEVICE AND NOZZLE AUTO-CLEANING METHOD" filed Jun. 2, 2016, the entire disclosure of which is incorporated herein by reference as part of the present application.

The invention claimed is:

1. A nozzle auto-cleaning device, comprising a base and a cleaning piece feeding unit disposed on the base, the base having a bearing surface on which the cleaning piece feeding unit is disposed, the cleaning piece feeding unit being configured to transport a cleaning piece installed inside the nozzle auto-cleaning device along a first direction intersected with the bearing surface so that a first portion of the cleaning piece is protruded in a direction away from the bearing surface and inserted into a nozzle, the base being configured to move along at least one direction of the first direction, a second direction, and a third direction, the second direction and the third direction being intersected in a plane of the bearing surface, so as to drive the first portion of the cleaning piece to move inside the nozzle, wherein the cleaning piece feeding unit comprises at least two clamping parts which are sequentially arrange along the first direction, each of the at least two clamping parts is configured to be switched between a clamping, state and a releasing state, and the at least two clamping parts comprise at least one movable clamping part which is configured to be movable along the first direction so that the cleaning piece is transported in a direction away from the bearing surface.

2. The nozzle auto-cleaning device according to claim 1, wherein the at least two clamping parts further comprise a fixed clamping part disposed farthest from the base along the first direction, wherein the fixed clamping part is configured to be fixed in the first direction.

3. The nozzle auto-cleaning device according to claim 2, wherein the cleaning piece feeding unit comprises one fixed clamping part and two movable clamping parts, which are arranged sequentially along the first direction.

4. The nozzle auto-cleaning device according to claim 3, further comprising a cleaning piece separator disposed along the first direction between the two movable clamping parts, wherein the cleaning piece separator is configured to separate the first portion of the cleaning piece from a remaining portion of the cleaning piece.

5. The nozzle auto-cleaning device according to claim 4, wherein the cleaning piece separator is a pair of blades, wherein the blades are disposed in parallel to the bearing surface and are symmetric with respect to the first direction.

6. The nozzle auto-cleaning device according to claim 4, further comprising a cleaning piece recovery unit disposed at one side of the cleaning piece separator, the cleaning piece recovery unit is configured to receive the first portion of the cleaning piece having been separated, and the cleaning piece recovery unit comprises: a recovery platform disposed in parallel to the bearing surface; and a stopper disposed above the recovery platform, wherein the stopper is configured to move towards or move away from the recovery platform in the first direction.

7. The nozzle auto-cleaning device according to claim 6, wherein the movable clamping part that is disposed at one side of the cleaning piece separator far away from the bearing surface is further configured to be movable to a position above the recovery platform and is configured to be turnable.

8. The nozzle auto-cleaning device according to claim 3, wherein each of the clamping parts comprises a pair of clamping elements, and the clamping elements of each of the clamping parts are arranged to be symmetric with respect to the first direction, and are configured to be movable towards one another to enter the clamping state or movable away from one another to enter the releasing state.

9. The nozzle auto-cleaning device according to claim 2, wherein each of the clamping parts comprises a pair of clamping elements, and the clamping elements of each of the clamping parts are arranged to be symmetric with respect to the first direction, and are configured to be movable towards one another to enter the clamping state or movable away from one another to enter the releasing state.

10. The nozzle auto-cleaning device according to claim 9, wherein the clamping elements of the fixed clamping part constitute an insertion channel along the first direction, and a size of at least a portion of the insertion channel, in a direction perpendicular to the first direction, is gradually decreased from an opening of the insertion channel towards a portion far away from the bearing surface.

11. The nozzle auto-cleaning device according to claim 1, wherein the cleaning piece is a transparent plastic piece.

12. The nozzle auto-cleaning device according to claim 1, wherein one side of the base that is facing to the bearing surface is provided with a movable holder.

13. The nozzle auto-cleaning device according to claim 1, wherein the first direction is perpendicular to the bearing surface; and the second direction and the third direction are perpendicular to each other.

14. A nozzle auto-cleaning method by using a nozzle auto-cleaning device, the nozzle auto-cleaning device comprising a base and a cleaning piece feeding unit disposed on the base; the base having a bearing surface and being configured to be movable along at least one direction of a first direction intersected with the bearing surface, a second direction, and a third direction, the second direction and the third direction being intersected with each other in a plane of the bearing surface; and the cleaning piece feeding unit being disposed on the bearing surface, the nozzle auto-cleaning method comprising:

controlling the cleaning piece feeding unit to transport a cleaning piece installed inside the nozzle auto-cleaning device along the first direction so that a first portion of the cleaning piece is protruded in a direction away from the bearing surface and inserted into a nozzle; and controlling the base to move along at least one direction of the first direction, the second direction, and the third direction so as to drive the first portion of the cleaning piece to move inside the nozzle, wherein the cleaning piece feeding unit in the nozzle auto-cleaning device comprises at least two clamping parts which are sequentially arranged along the first direction; each of the at least two clamping parts is configured to be switched between a clamping state and a releasing state; and the at least two clamping parts comprise at least one movable clamping part which is configured to be movable along the first direction so that the cleaning piece is transported in the direction away from the bearing surface, in the nozzle auto-cleaning method, controlling the cleaning piece feeding unit to transport the cleaning piece installed inside the nozzle auto-cleaning device along the first direction so that the first portion of the cleaning piece is protruded in the direction away from the bearing surface and inserted into the nozzle comprises:

controlling the at least one movable clamping part to move towards or move away from the bearing surface along the first direction so as to transport the first portion of the cleaning piece, the movable clamping part being in the releasing state during moving towards the bearing surface, and being in the clamping state during moving away from the bearing surface.

15. The nozzle auto-cleaning method according to claim 14, wherein in the cleaning piece feeding unit of the nozzle auto-cleaning device, the at least two clamping parts further comprise a fixed clamping part disposed farthest from the base along the first direction; clamping elements of the fixed clamping part are fixed in the first direction and constitute an insertion channel there-between along the first direction; an opening of the insertion channel facing to the bearing surface has a size, in a direction perpendicular to the first direction, larger than a size of a remaining portion of the insertion channel, in the direction perpendicular to the first direction, in the nozzle auto-cleaning method, controlling the cleaning piece feeding unit to transport the cleaning piece installed inside the nozzle auto-cleaning device along the first direction so that the first portion of the cleaning piece is protruded in the direction away from the bearing surface and inserted into the nozzle comprises:

inserting the first portion of the cleaning piece into the nozzle through the insertion channel while maintaining the cleaning piece in a state of being clamped by the cleaning piece feeding unit.

16. The nozzle auto-cleaning method according to claim 14, wherein the nozzle auto-cleaning device further comprises a cleaning piece separator disposed along the first direction between two movable clamping parts, upon controlling the base to move along the at least one direction of the first direction, the second direction, and the third direction so as to drive the first portion of the cleaning piece to move inside the nozzle, the nozzle auto-cleaning method further comprises:

controlling the cleaning piece separator to separate the first portion of the cleaning piece from a remaining portion of the cleaning piece in such a manner that the first portion of the cleaning piece is maintained in a state of being clamped by the movable clamping part disposed at one side of the cleaning piece separator far away from the bearing surface.

17. The nozzle auto-cleaning method according to claim 16, wherein the nozzle auto-cleaning device further comprises a cleaning piece recovery unit disposed at one side of the cleaning piece separator; the cleaning piece recovery unit comprises a recovery platform disposed in parallel to the bearing surface and a stopper disposed above the recovery platform, upon controlling the cleaning piece separator to separate the first portion of the cleaning piece from the remaining portion of the cleaning piece, the nozzle auto-cleaning method further comprises:

controlling the movable clamping part that clamps the first portion of the cleaning piece to move and turn so as to transport the first portion of the cleaning piece to a position above the recovery platform and below the stopper, at an orientation parallel to the recovery platform; and controlling the stopper to move towards the recovery platform along the first direction so as to press the first portion of the cleaning piece onto the recovery platform.

18. The nozzle auto-cleaning method according to claim 14, wherein the first direction is a direction perpendicular to the bearing surface; and the second direction and the third direction are perpendicular to each other.

* * * * *